US006896329B2

(12) United States Patent
Sander et al.

(10) Patent No.: US 6,896,329 B2
(45) Date of Patent: May 24, 2005

(54) CHAIR, IN PARTICULAR OFFICE CHAIR

(75) Inventors: Armin Sander, Nürnberg (DE); Martin Potrykus, Bamberg (DE)

(73) Assignee: Armin Sander, Nuremberg (DE)

( * ) Notice: Subject to any disclaimer, the term of this patent is extended or adjusted under 35 U.S.C. 154(b) by 68 days.

(21) Appl. No.: 10/144,222

(22) Filed: May 13, 2002

(65) Prior Publication Data

US 2002/0167209 A1 Nov. 14, 2002

(30) Foreign Application Priority Data

May 11, 2001 (DE) ..... 101 22 948

(51) Int. Cl.[7] ..... A47C 1/02

(52) U.S. Cl. ..... 297/316; 297/322; 297/321; 297/300.2; 297/300.1

(58) Field of Search ..... 297/300.2, 300.3, 297/300.1, 316, 317, 320, 321, 322

(56) References Cited

U.S. PATENT DOCUMENTS

| | | | | |
|---|---|---|---|---|
| 4,773,706 A | | 9/1988 | Hinrichs | |
| 5,080,318 A | * | 1/1992 | Takamatsu et al. | 248/598 |
| 5,308,144 A | | 5/1994 | Korn | |
| 5,354,120 A | * | 10/1994 | Volkle | 297/300.1 |
| 5,573,303 A | | 11/1996 | Doerner | |
| 5,582,459 A | * | 12/1996 | Hama et al. | 297/300.2 |
| 5,810,440 A | * | 9/1998 | Unwalla | 297/316 |
| 5,826,940 A | * | 10/1998 | Hodgdon | 297/303.1 |
| 5,931,531 A | * | 8/1999 | Assmann | 297/316 |
| 6,000,755 A | * | 12/1999 | Johannes | 297/300.2 |
| 6,431,649 B1 | * | 8/2002 | Hensel | 297/300.2 |
| 6,523,896 B1 | * | 2/2003 | Uhlenbrock | 297/300.4 |
| 2002/0180248 A1 | * | 12/2002 | Kinoshita et al. | 297/284.1 |

FOREIGN PATENT DOCUMENTS

| | | | | |
|---|---|---|---|---|
| DE | 42 19 599 A1 | | 12/1993 | |
| DE | 198 23 632 C1 | | 9/1999 | |
| EP | 549026 A1 | * | 6/1993 | A47C/1/024 |
| EP | 1 066 775 A1 | | 1/2001 | |

* cited by examiner

*Primary Examiner*—Peter M. Cuomo
*Assistant Examiner*—Stephanie Harris
(74) *Attorney, Agent, or Firm*—Laurence A. Greenberg; Werner H. Stemer; Ralph E. Locher

(57) ABSTRACT

The chair, particularly an office chair, has a backrest articulated to a seat support by way of a rest support. A seat surface is movable synchronously with the backrest. A front region of the seat surface is connected to the seat support via a sliding guide and a rear region is connected to the seat support via a seat link. A distance from an upper pivot point, which connects the seat link to the seat surface, to the backrest is shorter than the distance from a lower pivot point, which connects the seat link to the seat support, to the backrest. The movements of the backrest and of the seat surface are synchronized by a sliding guide provided between the seat link and the rest support.

5 Claims, 4 Drawing Sheets

CHAIR, IN PARTICULAR OFFICE CHAIR

BACKGROUND OF THE INVENTION

Field of the Invention

The invention relates to a chair, in particular an office chair, having a backrest, which is mounted in articulated fashion on a seat support by way of a rest support. The chair has a seat surface that can move synchronously with the backrest, the front region of which is connected to the seat support via a sliding guide and the rear region of which is connected to the seat support via a seat link.

Seating furniture and in particular chairs wherein the seat surface and the backrest move synchronously use various synchronizer mechanisms. The synchronizer mechanism is used to change the position of the seat surface at the same time as the backrest is being adjusted.

For example, German published patent application DE 42 19 599 A1 describes a chair with synchronously adjustable inclination of backrest and seat. There, a seat link, which is articulatedly mounted on the seat surface, in the rear region of the latter, on one side and on the seat support, on the other side, is used to raise the seat surface as the inclination of the backrest increases, while at the same time a drag lever, which is rotatably connected firstly to the seat surface and secondly to the rest link, pulls the seat surface toward the rear. As a result of this lifting of the seat surface in the rear region, facing the backrest, the user can slide forward on the seat surface when he is leaning back on the backrest. However, during a synchronous movement of backrest and seat surface, the seat surface should be inclined downward and toward the rear at least sufficiently far for the shear force exerted on the seat or the seat surface when the user leans back to be absorbed.

SUMMARY OF THE INVENTION

It is accordingly an object of the invention to provide a chair, in particular an office chair, which overcomes the above-mentioned disadvantages of the heretofore-known devices and methods of this general type and which has a particularly suitable synchronizer mechanism that is easy to produce.

With the foregoing and other objects in view there is provided, in accordance with the invention, a chair, comprising:

a seat support;

a backrest and a rest support articulatedly mounting the backrest to the seat support;

a seat surface disposed to move synchronously with the backrest, the seat surface having a front region and a rear region;

a sliding guide connecting the front region to the seat support;

a seat link connecting the rear region at an upper pivot point to the seat support at a lower pivot point;

wherein a distance from the upper pivot point to the backrest is shorter than a distance from the lower pivot point to the backrest; and a sliding guide between the seat link and the rest support for synchronizing a movement of the backrest and a movement of the seat surface.

In accordance with an added feature of the invention, the rest support has an oblong slot formed therein and a carrier bolt carried on the seat link is guided in the slot for synchronizing the movements of the backrest and the seat surface. Alternatively, the seat link has an oblong slot formed therein and a carrier bolt carried on the rest support is guided in the slot for synchronizing the movements of the backrest and the seat surface.

In accordance with another feature of the invention, a sliding guide extends obliquely downward from the front region of the seat surface toward the seat support.

In accordance with a concomitant feature of the invention, when the backrest is in the position wherein it is inclined back toward the rear, the upper pivot point that connects the seat link to the seat surface is at a lower level, relative to the seat surface, than a further pivot point at which the rest support is connected to the seat support.

In other words, the objects of the invention are achieved in that, firstly the distance from the upper pivot point, which connects the seat link to the seat surface, to the backrest is shorter than the distance from the lower pivot point, which connects the seat link to the seat support, to the backrest. As a result, as the inclination of the backrest increases, the seat surface is not lifted, but rather is advantageously lowered. Secondly, a sliding guide is provided between the seat link and the rest support in order to synchronize the movements of the backrest and of the seat surface.

The invention is based on the recognition that, in a chair or piece of seating furniture with an adjustable seat surface and an adjustable backrest, the possibilities of adjusting the seat surface, on the one hand, and the backrest, on the other hand, can initially be considered independently of one another. The design therefore initially has two degrees of freedom. The adjustment feature for the backrest has only a single degree of freedom if the articulation of the backrest on the seat support is produced in a simple way by means of the rest support which is rigidly connected to the backrest and is rotatably secured to the seat support via a single pivot pin. Furthermore, the seat surface may have more complex adjustment features, but nevertheless the starting point, as for the adjustability of the backrest, may also be that the possibilities of adjusting the seat surface can be described by a single degree of freedom. The movement of the seat surface may be either a translational movement or a tilting movement or a combination of various forms of movement.

Coupling the movements of the seat surface, on the one hand, and the backrest, on the other hand, is firstly intended to ensure that any possible position of: the backrest is assigned a position of the seat surface, with the result that the entire structure is limited to one degree of freedom. These requirements, as well as a coupling mechanism which is both more stable over a prolonged period and simple in terms of design are satisfied by a sliding guide for the seat link, which is rotatably connected to the seat surface, with respect to the rest support. The overall result is a particularly simple synchronizer mechanism. For this purpose, a carrier bolt arranged on the seat link may be guided in a slot provided in the rest support. Alternatively, the carrier bolt may be provided on the rest support and the slot guide may be provided in the seat link.

The sliding guide provided in the front region of the seat may be produced by a slot provided in the seat support and by a pin, which is guided in the slot and is rigidly connected to the seat surface, or by a cylinder. Irrespective of this, it is advantageous to provide a front sliding guide which runs obliquely downward toward the seat support. The inclined arrangement of the front sliding guide, which acts as a length-compensating element, of the seat surface not only avoids undesired lifting of the front edge of the seat surface when the backrest is inclined toward the rear, but also in fact lowers the front edge of the seat surface when the backrest is inclined toward the rear. The more the inclination of the sliding guide deviates from the horizontal and runs toward the vertical, the more pronounced this lowering becomes.

The inclination of the seat link toward the front and downward, originating from the upper pivot point, which is connected to the seat surface, of the seat link ergonomically increases the comfort since the seat surface is lowered primarily in its rear region when the backrest is inclined toward the rear, while at the same time the front edge of the seat surface moves downward and toward the rear. As a result, the seat surface, as is desired, acquires a greater freedom of movement in its rear region than in its front region.

Other features which are considered as characteristic for the invention are set forth in the appended claims.

Although the invention is illustrated and described herein as embodied in a chair, in particular office chair, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

Corresponding parts and functionally identical elements are provided with the same reference numerals throughout the drawing figures.

DESCRIPTION OF THE PREFERRED EMBODIMENTS

Figure 1:
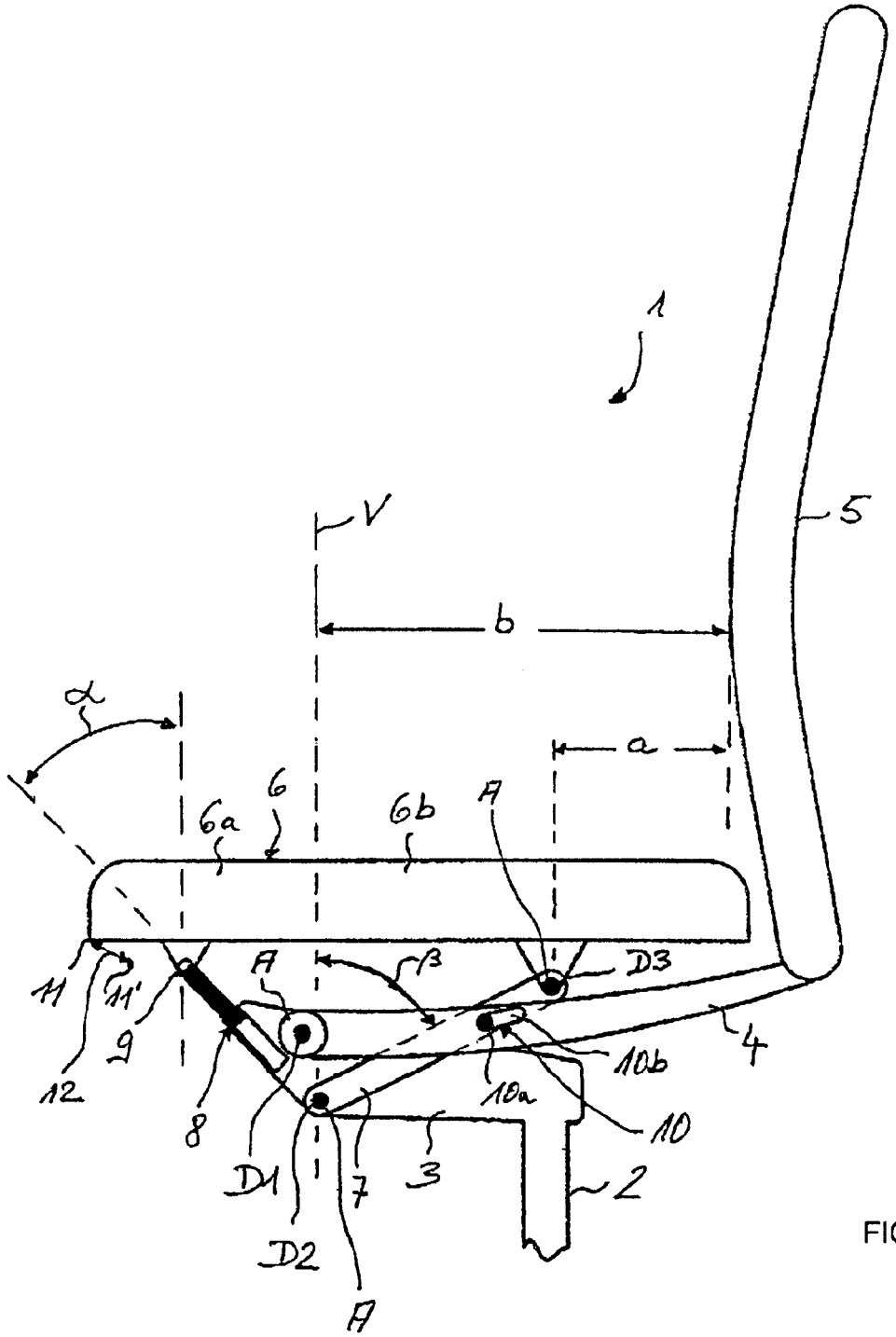
FIG. 1 is a diagrammatic side view of an office chair in the position of repose, with a first variant of a sliding guide between a rest support and a seat link.

Referring now to the figures of the drawing in detail and first, particularly, to FIG. 1 thereof, there is shown a chair 1 in the form of an office chair or secretary's chair with a seat support 3 that is fixedly connected to a pedestal 2 which is only partially illustrated. A backrest 5 is pivotally connected to the seat support 3 by means of a rest link 4. The backrest 5 can be inclined toward the rear out of the at-rest position shown in FIGS. 1 and 3 into the reclined position illustrated in FIGS. 2 and 4. The inclination of the backrest 5 is effected by rotation about a pivot point D1. For this purpose, the rest link 4, which is fixedly connected to the backrest 5, is connected to the seat support 3 by means of a pivot pin A, the pivot point D1 being determined substantially by the center axis of this pivot pin A.

Furthermore, a seat surface 6 is articulated on the seat support 3 by a seat link 7, which in the exemplary embodiment is straight. However, this link may also be designed to bend or curve convexly toward the seat surface 6. The seat link 7 is rotatably connected to the seat support 3 by means of a pivot joint D2 and is rotatably connected to the seat surface 6 in the rear region of the latter, i.e. in the rear seat half 6*b* facing the backrest 5, by means of a pivot joint D3. The pivot points D2 and D3 are once again produced by corresponding pivot pins A, by means of which the seat link 7 is rotatably connected firstly to the seat support 3 and secondly to the seat surface 6.

In the front region, i.e. in the front seat half 6*a* which is remote from the backrest 5, the seat surface 6 is connected to the seat support 3 via a sliding guide 8. The sliding guide 8 may, in a manner which is not illustrated in more detail, be designed as a slot in the seat support 3 and a rigid pin 9 which is guided in the slot and is connected to the seat surface 6 or—as is illustrated—as a cylinder guided in the seat support 3. This cylinder is then rotatably connected to the seat surface 6 via the pin 9. The sliding guide 8 is inclined toward the pedestal 2. The angle of inclination a between the sliding guide 8 and the vertical V is in this case $\alpha=(45\pm30)°$, $\alpha$ preferably being 45°.

Figure 2:
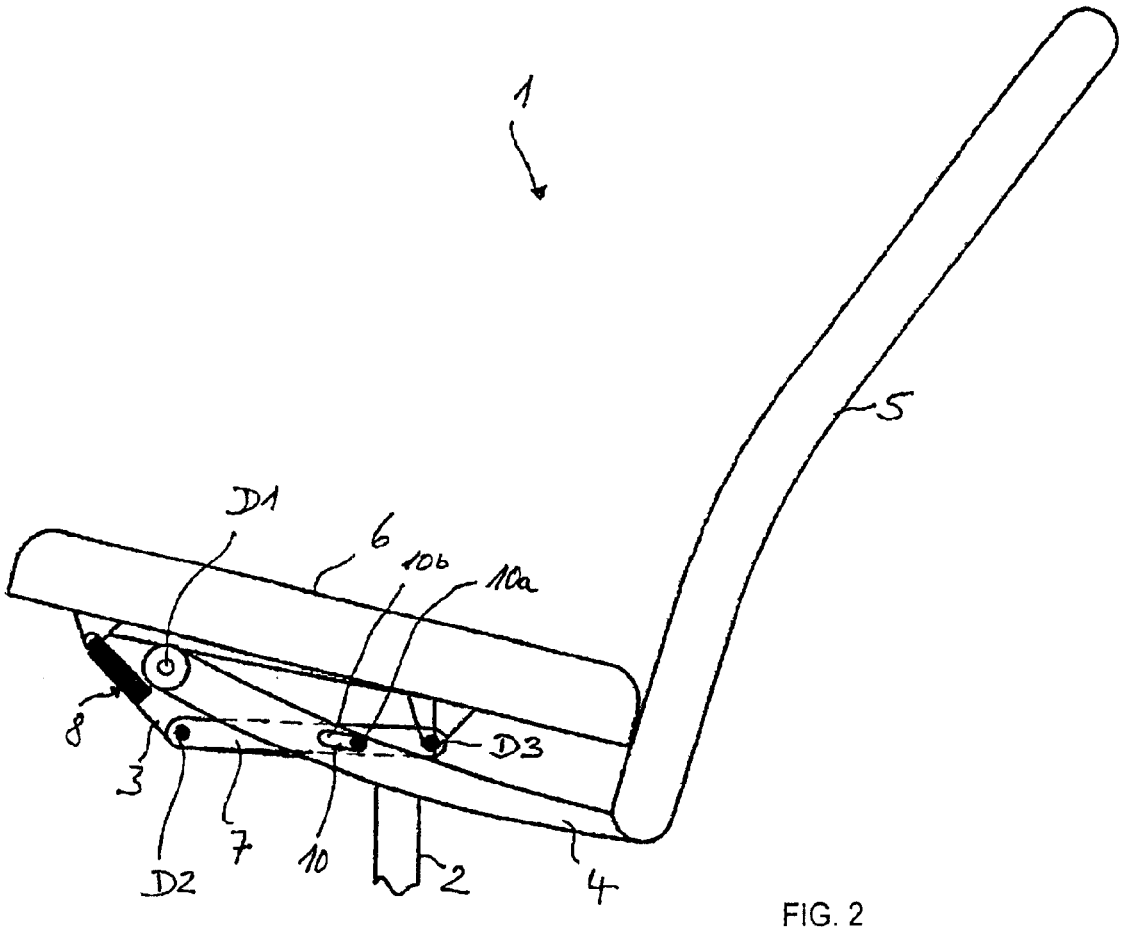
FIG. 2 is a similar view of the office chair shown in FIG. 1 in its limit position wherein it has been reclined toward the rear.

In the embodiment illustrated in FIGS. 1 and 2, to synchronize the movements of the backrest 5 and of the seat surface 6, a carrier bolt 10*a* arranged on the seat link 7 is guided in a slot 10*b* provided in the rest support 4, so as to form a sliding guide 10. Alternatively, according to the variant illustrated in FIGS. 3 and 4, to form the sliding guide 10 the carrier bolt 10*a* is arranged on the rest support 4, while the slot 10*b* is provided in the seat link 7.

Figure 4:
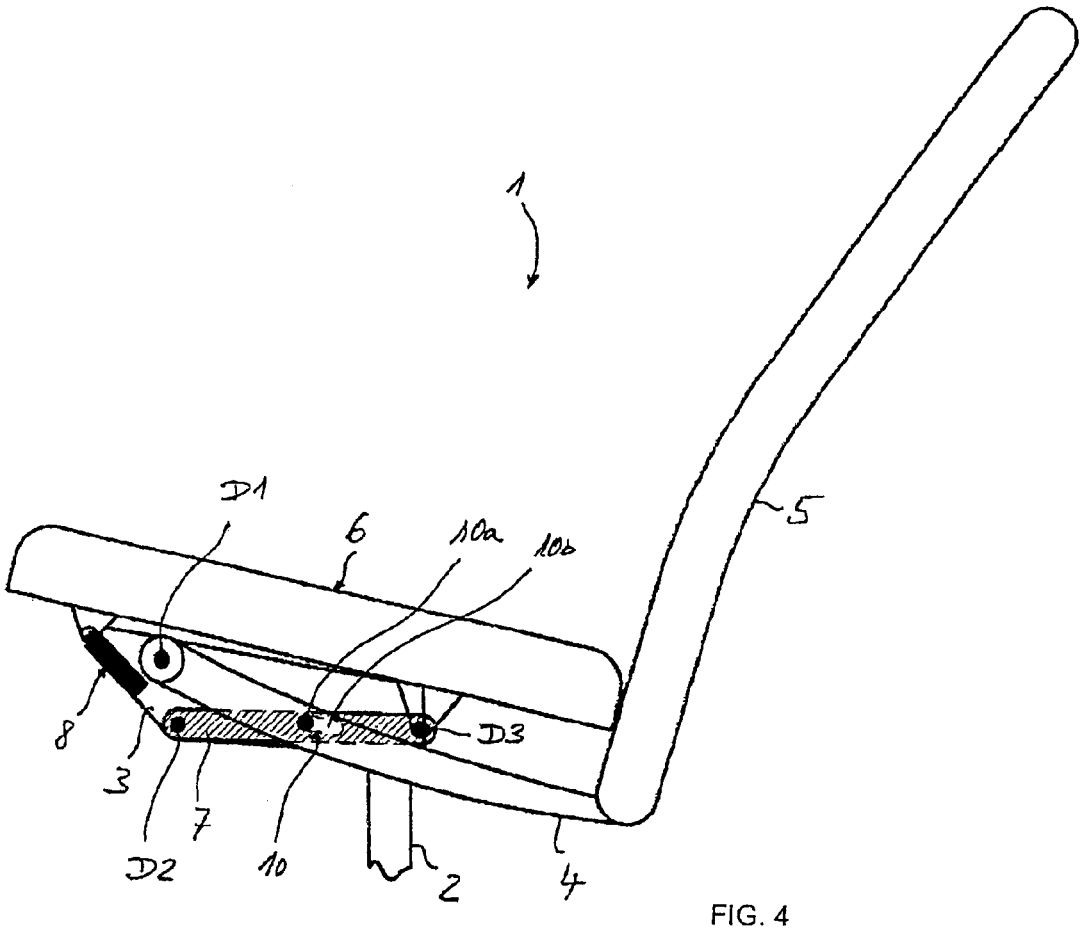
FIG. 4 is a similar view of the office chair shown in FIG. 3 in its limit position wherein it has been reclined toward the rear.

If the backrest 5 is moved into the position illustrated in FIGS. 2 and 4 as a result of it being inclined toward the rear, this inclination causes the rest support 4 to rotate in the clockwise direction, so that the seat link 7, together with the seat surface 6, moves downward. In the process, the angle $\beta$ between the seat link 7 and the vertical V increases from between about 45° and 60° to about 90°. In the limit position, therefore, the seat link 7 is virtually horizontal.

As a result of the inclination of the backrest 4, the seat surface 6 is lowered in its rear region 6*b* together with the pivot point D3. At the same time, the front edge 11 of the seat surface 6 moves downward and toward the rear, with the length compensation required for this purpose being effected by the front sliding guide 8.

Figure 3:
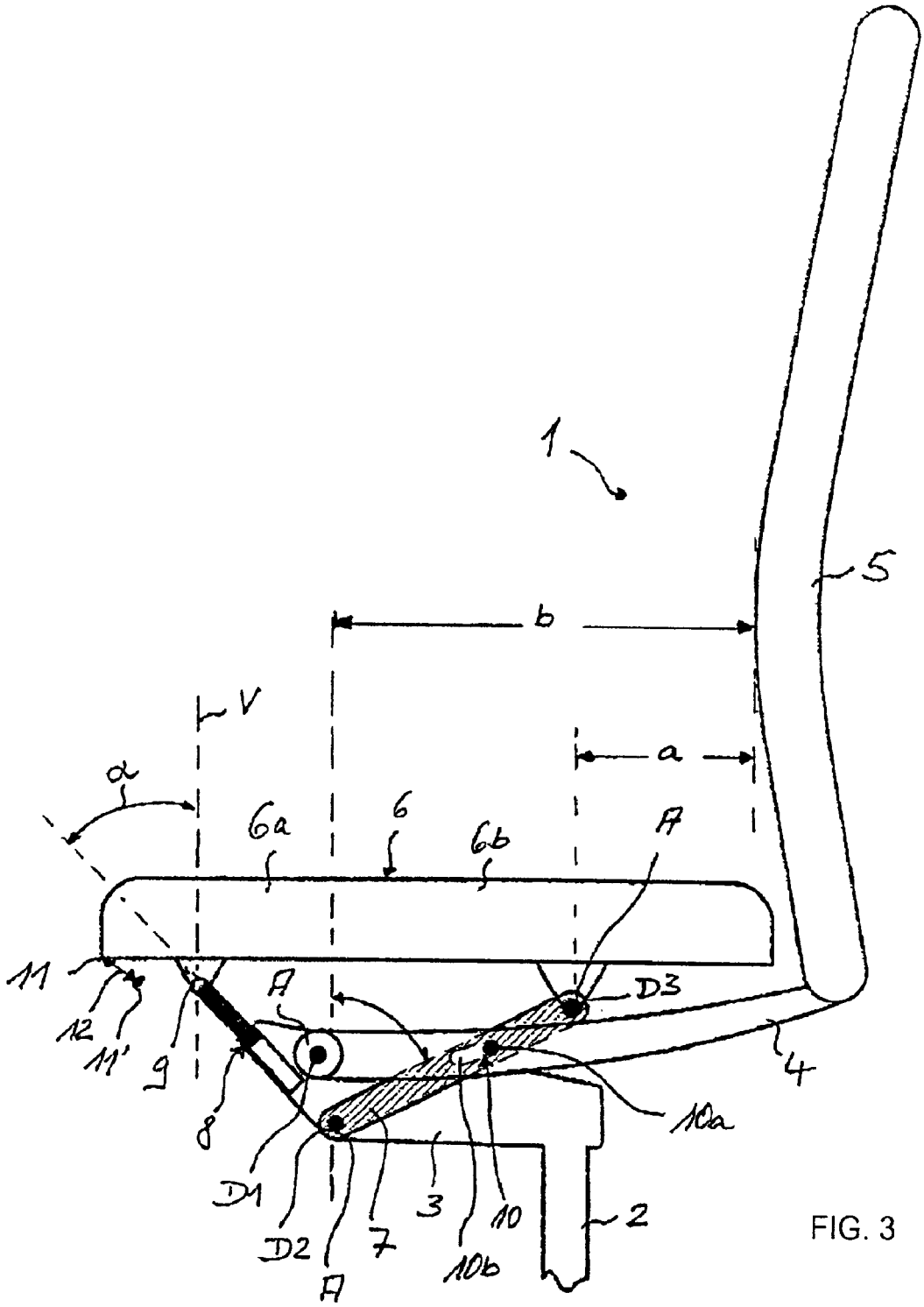
FIG. 3 is a diagrammatic side view of a second embodiment of the sliding guide between rest support and seat link.

The resultant displacement of the front edge 11 of the seat surface 6 to the point 11' illustrated in FIGS. 1 and 3 is illustrated by the length arrow 12. This lowering of the front edge 13 of the seat is less than the lowering of the rear region 6*b* of the seat surface 6, so that overall the latter is lowered and inclined in the clockwise direction.

In the position wherein it has been reclined toward the rear, the upper pivot point D3, which connects the seat link 7 to the seat surface 6, is at a lower level, based on the seat surface 6, than the pivot point D1, which connects the rest link 4 to the seat support 3, while in the at-rest position the pivot point D1 lies below the pivot point D3.

We claim:

1. A chair, comprising:

a seat support;

a backrest and a rest support articulatedly mounting said backrest to said seat support;

a seat surface disposed to move synchronously with said backrest, said seat surface having a front region and a rear region;

a first sliding guide connecting said front region to said seat support;

a seat link connecting said rear region at an upper pivot point and said seat support at a lower pivot point;

wherein a distance from said upper pivot point to said backrest is shorter than a distance from said lower pivot point to said backrest; and a second sliding guide having an oblong slot and a carrier bolt between said seat link and said rest support for synchronizing a movement of said backrest and a movement of said seat surface.

2. The chair according to claim 1, wherein said rest support has said oblong slot formed therein and said carrier bolt carried on said seat link is guided in said slot for synchronizing the movements of said backrest and said seat surface.

3. The chair according to claim 1, wherein said seat link has said oblong slot formed therein and said carrier bolt carried on said rest support is guided in said slot for synchronizing the movements of said backrest and said seat surface.

4. The chair according to claim 1, wherein said first sliding guide extends obliquely downward from said front region of said seat surface toward said seat support.

5. The chair according to claim 1, wherein, when said backrest is in the position wherein it is inclined back toward the rear, said upper pivot point that connects said seat link to said seat surface is at a lower level, relative to said seat surface, than a further pivot point at which said rest support is connected to said seat support.

* * * * *